US006820634B2

(12) United States Patent
Reichert et al.

(10) Patent No.: US 6,820,634 B2
(45) Date of Patent: Nov. 23, 2004

(54) VALVE BLOCK AND VALVE BLOCK ASSEMBLY FOR PRODUCING SUCH A VALVE BLOCK

(75) Inventors: Uwe Reichert, Schlüchtern (DE); Claus-Jürgen Becker, Wolfsburg (DE)

(73) Assignees: WOCO Franz-Josef Wolf & Co. GmbH, Bad Soden-Salmuenster (DE); Volkswagen AG, Wolfsburg (DE)

( * ) Notice: Subject to any disclaimer, the term of this patent is extended or adjusted under 35 U.S.C. 154(b) by 0 days.

(21) Appl. No.: 10/312,746

(22) PCT Filed: Aug. 1, 2001

(86) PCT No.: PCT/DE01/02949

§ 371 (c)(1),
(2), (4) Date: Dec. 27, 2002

(87) PCT Pub. No.: WO02/14697

PCT Pub. Date: Feb. 21, 2002

(65) Prior Publication Data

US 2003/0102030 A1 Jun. 5, 2003

(30) Foreign Application Priority Data

Aug. 15, 2000 (DE) ..... 100 40 559

(51) Int. Cl.[7] ..... F15B 13/00
(52) U.S. Cl. ..... 137/271
(58) Field of Search ..... 137/271, 269, 137/884

(56) References Cited

U.S. PATENT DOCUMENTS

| | | | | |
|---|---|---|---|---|
| 4,549,248 A | | 10/1985 | Stoll | |
| 4,726,778 A | | 2/1988 | d'Agostino et al. | |
| 4,896,700 A | * | 1/1990 | Stoll | 137/884 |
| 4,929,038 A | | 5/1990 | Reinartz et al. | |
| 5,301,717 A | | 4/1994 | Goedecke | |
| 5,520,546 A | | 5/1996 | Klinger et al. | |
| 5,588,465 A | | 12/1996 | Witowski et al. | |
| 5,700,071 A | | 12/1997 | Steffes et al. | |
| 6,053,198 A | | 4/2000 | Atkin et al. | |
| 6,148,862 A | * | 11/2000 | Doll | 137/271 |
| 6,354,674 B1 | | 3/2002 | Iwamoto et al. | |

FOREIGN PATENT DOCUMENTS

| | | |
|---|---|---|
| AT | 250116 | 10/1966 |
| DE | 32 38 750 | 6/1984 |
| DE | 41 11 893 | 4/1995 |
| DE | 199 59 632 | 6/2000 |
| EP | 0 169 963 | 2/1986 |
| EP | 0 627 349 | 12/1994 |
| EP | 0 686 239 | 1/1997 |
| EP | 0 905 383 | 3/1999 |
| FR | 2 250 907 | 6/1975 |

* cited by examiner

*Primary Examiner*—Kevin Lee
(74) *Attorney, Agent, or Firm*—Schiff Hardin LLP

(57) ABSTRACT

A valve block for at least two valves fixable in a housing having an electric cabling to electrical terminals for the valves and a pneumatic circuit to pneumatic terminals for the valves. The block has an electrical plug connected to the electrical cabling, which extends to the electrical terminals and has a pneumatic plug connected to the pneumatic circuit, which extends to the pneumatic terminals, and the pneumatic circuit proceeds at least partly in a replaceable insert of the housing that can be selected dependent on the valves and/or their function. The pneumatic plug has at least one pneumatic plug connector selectable dependent on the valves and/or their function.

16 Claims, 2 Drawing Sheets

VALVE BLOCK AND VALVE BLOCK ASSEMBLY FOR PRODUCING SUCH A VALVE BLOCK

BACKGROUND OF THE INVENTION

The invention is directed to a valve block for at least two valves fixable in a housing having an electric cabling to electrical terminals for the valves and a pneumatic cabling or ducting to pneumatic terminals for the valves, and is also directed to a set of valve blocks for producing such a valve block A plurality of valves that also partly perform different functions are often employed in a higher-ranking unit, for example in motor vehicles. Disadvantageously, these valves have hitherto usually been individually assembled, which, in particular, complicates as well as lengthens assembly and thus causes the ultimate price of the higher-ranking unit to rise.

For example, EP 0 627 349 A1 discloses a valve block of the species wherein an intermediate plate for the electrical cabling is provided between a part containing solenoid valves and a cover that covers this part. The utilization of such an intermediate plate leads to a design that is complicated and, thus, also costly.

Another valve block of the species is disclosed by EP 0 686 239 B1, this reference discloses a base plate with a pneumatic cabling or ducting in the form of channels for intake and exhaust air from connection openings in an aperture pattern suitable for the attachment of specific valves to a user and with an electrical cabling comprising an electrical installation device placed in a shaft that proceeds parallel to the pneumatic cabling. Although this known valve block can be simply and quickly assembled, it nonetheless exhibits a limited range of employment or, respectively, must be completely redimensioned for every specific application. This again is cost-intensive.

SUMMARY OF THE INVENTION

An object of the present invention is therefore to improve the valve block of the species such that the disadvantages of the Prior Art are overcome, particularly that manufacturing as well as assembly costs are reduced and the range of employment is widened.

This object is inventively achieved by an electrical plug proceeding wherefrom the electrical cabling extends to the electrical terminals and by an pneumatic plug proceeding wherefrom the pneumatic cabling or circuit extends to the pneumatic terminals, whereby the pneumatic cabling proceeds at least partly in a replaceable or exchangeable insert of the housing that can be selected dependent on the valves and/or their function and/or the pneumatic plug comprises at least one pneumatic plug connector selectable dependent on the valves and/or their function.

It can thereby be provided that the housing comprises a floor part, preferably in the form of an injection molded part, whereby the floor part encompasses the electrical plug, the electrical cabling, the electrical terminals, at least a part of the pneumatic plug, at least a part of the pneumatic cabling or circuit, preferably in the form of air delivery openings and/or air delivery channels and can be or, respectively, is firmly connectable to the replaceable insert.

Embodiments of the invention can be characterized in that the replaceable insert comprises air delivery openings and/or air delivery channels that can be closed with a first cover, preferably composed of an injection molded part, and particularly weldable with ultrasound.

It can also be provided that the replaceable insert is arranged at the outside of a region of the floor part and the valves are arranged at the inside of said region of the floor part.

In addition, the pneumatic cabling and/or the pneumatic terminals can comprise air delivery openings and/or air delivery channels having a respective cross-section of a range of 1 through 6 mm×1 through 6 mm, and preferably a range of 4 through 5 mm×4 through 5 mm.

In addition, ring seals can be provided at pneumatic interfaces.

At least one check valve can also be provided in the pneumatic cabling or circuit.

Preferred developments of the invention are characterized in that the pneumatic plug comprises two pneumatic plug-type connections, whereby a first pneumatic plug-type connection can be releasably as well as lockably attached, particularly via a tongue and groove connection, to the second pneumatic plug-type connection, which is preferably a component part of the injection molded part of the floor part.

It is also inventively preferred that the floor part, particularly the selectable pneumatic plug-type connection and/or the replaceable insert, comprises or, respectively, comprise a coding that is dependent on the valves and/or their function.

It can also be provided that the electrical plug and the pneumatic plug are arranged at outside walls of the floor part that lie opposite one another.

The invention also proposes that the floor part comprises at least one access opening for the insertion of the valves and the inside of the floor part together with the valves arranged therein can be cast out, particularly with a resin, and/or can be closed, particularly latched, with a second cover, preferably composed of an injection molded part.

At least one centering aid can also be inventively provided in the floor part for each valve.

In addition, embodiments can be provided with a fastening means, particularly as a component part of the injection molded part of the floor part, and/or with a damping element, preferably in interaction with the fastening means.

It is also inventively preferred that the valves are attached in the housing via a plug connection, whereby the pneumatic valve terminals of the valves are preferably pluggable into the pneumatic terminals in the form of air delivery openings in the floor part for the replaceable insert and/or the electrical terminals in the form of contacts projecting from the floor part are pluggable into openings for the electrical valve terminals of the valves.

Three valves can be arranged in the housing of an inventive valve block.

In addition, the invention offers a set of valve block units for the production of an inventive valve block.

It can thereby be provided that the valves, on the one hand, and the replaceable inserts and/or the pneumatic plug-type connections, on the other hand, comprise a coding matched to one another, so that a valve block having specific functions is producible dependent thereon.

The invention is thus based on the surprising perception that a plurality of valves can be attached in a housing, preferably via a simple plug-type connection, given simultaneous connection to a single electrical plug as well as to a single pneumatic plug. The inventive valve block can then be easily and quickly installed into any higher-ranking unit by connecting electric cables to the single electrical plug and air hoses to the single pneumatic plug.

Advantageously, a plurality of different pneumatic cablings or circuits of the valves of the valve block are possible by employing a selectable replaceable insert and/or a selectable pneumatic plug-type connection having specific air delivery openings and/or air delivery channels in the valve block, so that standardized valve blocks for different valves and/or functions can be manufactured in, so to speak, modular organization from a set of valve block units for further work simplification. The combination versatility of valves that are employable in an inventive valve block is thereby great due to the interchangeability of the replaceable inserts and/or pneumatic plug-type connections. It is not only the employment of different valves but also the implementation of different functions by the valves that is possible due to the flexibility in the pneumatic cabling.

In order to essentially prevent a malfunction of the valve block due to incorrect assembly, at least the replaceable inserts and/or pneumatic plug-type connections inventively comprise codings dependent on the desired overall function.

For example, an inventive valve block for utilization in a motor vehicle can comprise two electro-pneumatic transducers, the one thereof serving for adjustment of a vacuum actuator in the exhaust gas return system and the other thereof serving for the control of a vacuum actuator for a turbo-supercharger control, and can comprise an electrical reversing valve in the form of a 3/2-way valve for driving a vacuum actuator for a stop flap as particularly utilized in diesel motors.

Further features and advantages of the invention derive from the following description, wherein an exemplary embodiment of the invention is explained in detail on the basis of schematic drawings.

DESCRIPTION OF THE PREFERRED EMBODIMENTS

Figure 1:
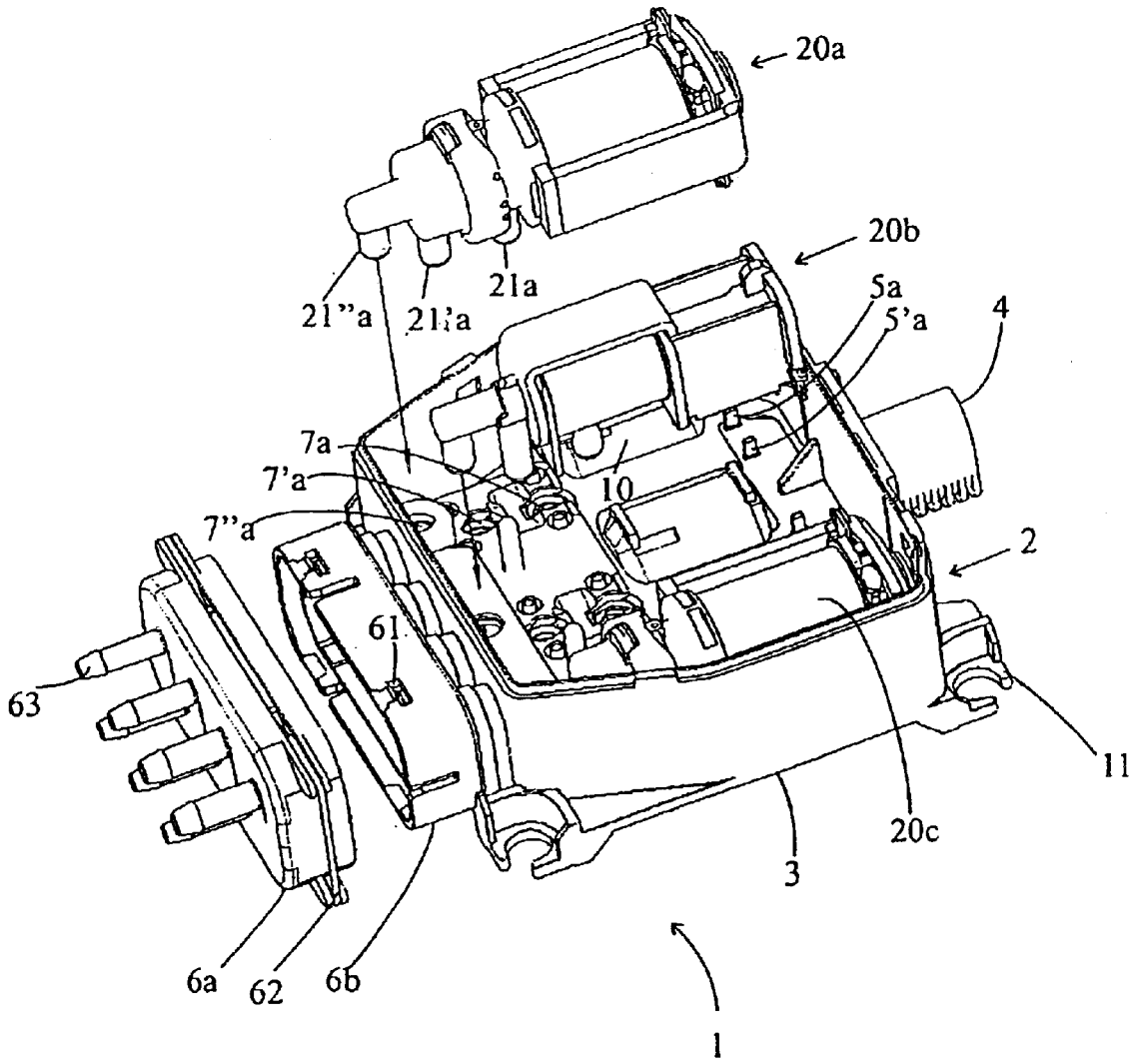
FIG. 1 is a partially exploded perspective view of an inventive valve block.
Figure 2:
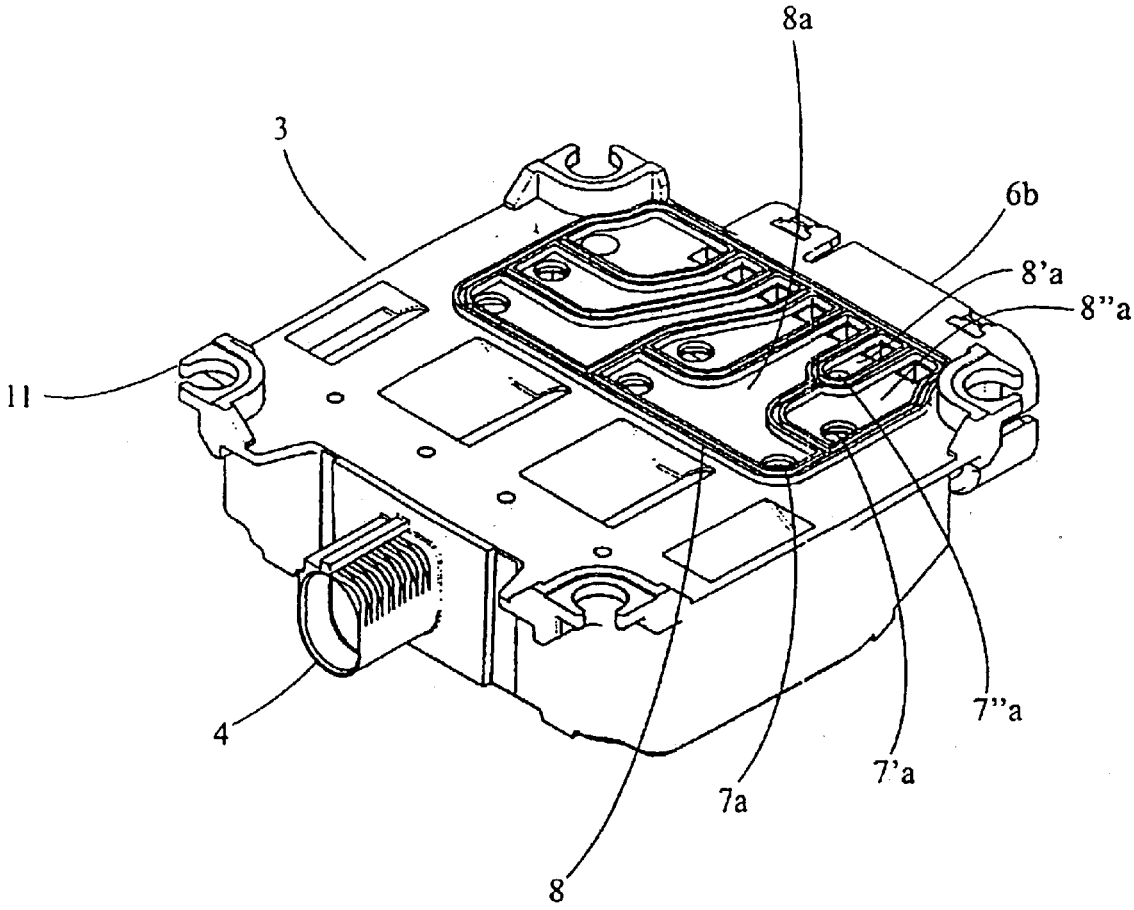
FIG. 2 is a perspective bottom view of the valve block shown in FIG. 1.

As can be derived from FIGS. 1 and 2, an inventive valve block 1 comprises a housing 2 that in turn comprises a floor or base part 3. The floor part 3 in turn contains a single electrical plug 4 at one side wall that is connected via an electrical cabling (not shown) to projecting contacts 5, 5'*a* as electrical terminals, and contains a single pneumatic plug 6*a*, 6*b* at a side wall lying opposite the electrical plug 4. The single pneumatic plug has interactive connections with air delivery openings 7*a*, 7'*a*, 7"*a*. The pneumatic cabling or circuit between the pneumatic plug fashioned in the form of two pneumatic plug-type connections 6*a*, 6*b* and the air delivery openings 7*a*, 7'*a*, 7"*a* representing pneumatic terminals is thereby fashioned in a replaceable or selectable insert 8 (FIG. 2) in the form of air delivery channels 8*a*, 8'*a*, 8"*a*. Additionally, centering aids 10 (FIG. 1) are provided in the floor part 3. Finally, the floor part 3 also comprises fastening openings 11 for installation of the valve block in a higher-ranking unit (not shown).

Three valves 20*a*, 20*b*, 20*c* are pluggable into the floor part 3 by inserting their pneumatic valve terminals 21*a*, 21'*a*, 21"*a* into the air delivery openings 7*a*, 7'*a*, 7"*a* with a simultaneous engagement of the contacts 5*a*, 5'*a* into electrical valve terminals (not shown).

The two pneumatic plug-type connections 6*a*, 6*b* are releasably and latchably connectable to one another via a tongue and groove connection 61, 62, whereby the outer pneumatic plug-type connection 6*a* comprises a plurality of hose connections 63.

The valve block 1 described in terms of its structure with reference to FIGS. 1 and 2 can be assembled from an inventive valve block set in the following way:

First, the valves 20*a*, 20*b*, 20*c* as well as their pneumatic cabling or circuit in the form of the replaceable insert 8 are selected according to a coding dependent on the desired function of the valve block 1.

Subsequently, the replaceable or exchangeable insert 8 is latched to the rest of the floor part 3. Next, the replaceable insert 8 is ultrasound-welded to a cover (not shown).

Subsequently, the valves 20*a*, 20*b*, 20*c* can be successively plugged into the floor part 3 upon utilization of the centering aid 10, so that an electrical contact arises between the contacts 5*a*, 5'*a* and the electrical valve terminals and a tight connection arises between the pneumatic valve terminals 21*a*, 21'*a*, 21"*a* and the air delivery openings 7*a*, 7'*a*, 7"*a*.

As soon as the valves 20*a*, 20*b*, 20*c* have been firmly plugged into the floor part, the floor part 3 can be cast out with resin for improving the thermal conductivity, for protection against overheating and for increasing the maximum on duration. Subsequently, another cover (not shown) can be latched to the open end of the floor part 3.

The valve block 1 can then be attached to a higher-ranking unit such as a motor vehicle by inserting screws (not shown) into the fastening openings 11 in which rubber bumpers (not shown) are additionally located for damping.

An electrical cable (not shown) can then be connected to the electrical plug 4.

Subsequently, a plurality of hoses (not shown) can be connected to the hose connections 63 of the outer pneumatic plug-type connections 6*a* according to a coding dependent on the selected function of the valve block 1. Next, the outer pneumatic plug-type connection 6*a* can be placed onto the rest of the valve block 1, whereby a corresponding emplacement is only possible when the inner pneumatic plug-type connection 6*b* has been selected according to the coding of the outer pneumatic plug-type connection 6*a*. Thus, for example, the geometry of the pneumatic plug-type connections 6*a*, 6*b* of each and every coding can be different dependent on the function of the valve block 1. The inventive valve block 1 is ready to function as soon as the pneumatic plug-type connections 6*a*, 6*b* have been connected to one another.

Both individually as well as in arbitrary combinations, the features of the invention disclosed in the above description, in the claims as well as in the drawings can be critical for realizing the various embodiments of the invention.

We claim:

1. A valve block for at least two valves, said block comprising a housing for fixably receiving the valves, said housing having an electrical cabling from an electrical plug to electrical terminals for the valves and a pneumatic circuit from a pneumatic plug to pneumatic terminals for the valves; the pneumatic plug having at least one pneumatic plug connector selectable for the valves and the function of the valves and the housing having a selectable insert that can be selected dependent on the valves and the function of the valves, said selectable insert and the plug connector being releasably connected to the housing.

2. A valve block according to claim 1, wherein the housing comprises a floor part for the acceptance of the valves, said floor part encompasses the electrical plug, the electrical cabling, the electrical terminals, at least a part of the pneumatic plug, at least a part of the pneumatic circuit, and the pneumatic terminals, said floor part can be firmly connectable to the selectable insert.

3. A valve block according to claim 2, wherein the selectable insert is arranged at the outside of a region of the floor part and the valves are arranged at the inside of said region of the floor part.

4. A valve block according to claim 2, wherein the pneumatic plug comprises two pneumatic plug-type connections, wherein a first pneumatic plug-type connection can be releasably as well as lockably attached to the second pneumatic plug-type connection, which is a component part of an injection molded part of the floor part.

5. A valve block according to claim 2, wherein the floor part, each selectable pneumatic plug-type connection and the selectable insert have a coding that is dependent on the valves and their function.

6. A valve block according to claim 2, wherein the electrical plug and the pneumatic plug are arranged outside of the floor part on opposite sides thereof.

7. A valve block according to claim 2, wherein the floor part comprises at least one access opening for the insertion of the valves and the inside of the floor part together with the valves arranged therein can be cast out with a resin and/or can be closed with a second cover.

8. A valve block according to claim 2, wherein the floor part has at least one centering aid for each valve.

9. A valve block according to claim 2, wherein the valves are attached in the housing via a plug connection, whereby the pneumatic valve terminals of the valves are preferably pluggable into the pneumatic terminals in the form of air delivery openings in the floor part for the selectable insert and the electrical terminals in the form of contacts projecting from the floor part are pluggable into openings for the electrical valve terminals of the valves.

10. A valve block according to claim 1, wherein three valves are arranged in the housing.

11. A valve block according to claim 1, wherein the selectable insert comprises air delivery openings and air delivery channels that can be closed with a first cover weldable with ultrasound.

12. A valve block according to claim 1, wherein the pneumatic circuit and the pneumatic terminals have air delivery openings and air delivery channels having a respective cross-section of 1 through 6 mm×1 through 6 mm.

13. A valve block according to claim 12, wherein the cross-section is 4 to 5 mm×4 to 5 mm.

14. A valve block according to claim 1, which includes ring seals at pneumatic interfaces.

15. A valve block according to claim 1, which includes at least one check valve in the pneumatic circuit.

16. A valve block set for the production of a valve block according to claim 1, wherein the valves, on the one hand, and the selectable inserts and the pneumatic plug-type connections, on the other hand, comprise a coding matched to one another and a valve block having a specific function being producible dependent on the coding.

* * * * *